US006022265A

United States Patent [19]

Drill et al.

[11] Patent Number: 6,022,265

[45] Date of Patent: Feb. 8, 2000

[54] COMPLEMENTARY MATERIAL CONDITIONING SYSTEM FOR A CHEMICAL MECHANICAL POLISHING MACHINE

[75] Inventors: Charles F. Drill, Boulder Creek; Calvin Gabriel, Cupertino; Milind Weling, San Jose; Richard Russ, Santa Clara; David E. Henderson, Fremont, all of Calif.

[73] Assignee: VLSI Technology, Inc., San Jose, Calif.

[21] Appl. No.: 09/100,276

[22] Filed: Jun. 19, 1998

[51] Int. Cl.[7] ..... B24B 1/00

[52] U.S. Cl. ..... 451/56; 451/36; 451/72

[58] Field of Search ..... 451/36, 41, 56, 451/72; 438/692, 693

[56] References Cited

U.S. PATENT DOCUMENTS

| | | | |
|---|---|---|---|
| 5,456,627 | 10/1995 | Jackson et al. | 451/11 |
| 5,486,131 | 1/1996 | Cesna et al. | 451/56 |
| 5,536,202 | 7/1996 | Appel et al. | 451/285 |
| 5,667,433 | 9/1997 | Mallon | 451/287 |
| 5,683,289 | 11/1997 | Hempel, Jr. | 451/56 |
| 5,823,854 | 10/1998 | Chen | 451/9 |
| 5,893,753 | 4/1999 | Hempel, Jr. | 438/691 |

*Primary Examiner*—Timothy V. Eley
*Assistant Examiner*—Dung Van Nguyen
*Attorney, Agent, or Firm*—Wagner, Murabito & Hao LLP

[57] ABSTRACT

A complementary conditioning system for use in chemical mechanical polishing (CMP). The present invention functions with a CMP machine adapted for polishing a semiconductor wafer having tungsten components fabricated thereon. A polishing pad is mounted on the CMP machine. The polishing pad has a polishing surface configured for polishing the semiconductor wafer and its tungsten components. The performance of the polishing surface is characterized by a polishing efficiency. A complementary end-effector is mounted on the CMP machine. The complementary end-effector is adapted to chemically complement the tungsten components on the semiconductor wafer. The complementary end-effector is further adapted to contact the polishing surface and improve the polishing efficiency by chemically enhancing the polishing surface, thereby obtaining a more efficient removal rate for the chemical mechanical polishing.

15 Claims, 7 Drawing Sheets

COMPLEMENTARY MATERIAL CONDITIONING SYSTEM FOR A CHEMICAL MECHANICAL POLISHING MACHINE

TECHNICAL FIELD

The field of the present invention pertains to semiconductor fabrication processing. More particularly, the present invention relates to a system for chemically conditioning a polishing pad in a chemical mechanical polishing (CMP) machine to improve process efficiency.

BACKGROUND ART

Most of the power and usefulness of today's digital IC devices can be attributed to the increasing levels of integration. More and more components (resistors, diodes, transistors, and the like) are continually being integrated into the underlying chip, or IC. The starting material for typical ICs is very high purity silicon. The material is grown as a single crystal and takes the shape of a solid cylinder. This crystal is then sawed (like a loaf of bread) to produce wafers typically 10 to 30 cm in diameter and 250 microns thick.

The geometry of the features of the IC components is commonly defined photographically through a process known as photolithography. Very fine surface geometries can be reproduced accurately by this technique. The photolithography process is used to define component regions and build up components one layer on top of another. Complex ICs can often have many different built-up layers, each layer having components, each layer having differing interconnections, and each layer stacked on top of the previous layer. The resulting topography of these complex IC's often resembles familiar terrestrial "mountain ranges," with many "hills" and "valleys," as the IC components are built up on the underlying surface of the silicon wafer.

In the photolithography process, a mask image, or pattern, defining the various components, is focused onto a photosensitive layer using ultraviolet light. The image is focused onto the surface using the optical means of the photolithography tool and is imprinted into the photosensitive layer. To build ever smaller features, increasingly fine images must be focused onto the surface of the photosensitive layer, i.e. optical resolution must increase. As optical resolution increases, the depth of focus of the mask image correspondingly narrows. This is due to the narrow range in depth of focus imposed by the high numerical aperture lenses in the photolithography tool. This narrowing depth of focus is often the limiting factor with regard to the degree of resolution obtainable, as well as the limiting factor in regard to the smallest components obtainable using the photolithography tool. The extreme topography of complex ICs, the "hills" and "valleys," exaggerates the effects of decreasing depth of focus. Thus, in order to properly focus the mask image defining sub-micron geometries onto the photosensitive layer, a precisely flat surface is desired. The precisely flat (i.e. fully planarized) surface will allow for extremely small depths of focus which, in turn, will allow the definition and subsequent fabrication of extremely small components.

Chemical-mechanical polishing (CMP) is the preferred method of obtaining full planarization of a wafer. It involves removing a portion of a sacrificial layer of dielectric material using mechanical contact between the wafer and a moving polishing pad saturated with slurry. Polishing flattens out height differences, since high areas of topography (hills) are removed faster than areas of low areas of topography (valleys). Polishing is the only technique with the capability of smoothing out topography over millimeter scale planarization distances leading to maximum planarization angles of much less than one degree after polishing.

FIG. 1A shows a top down view of a CMP machine 100 and FIG. 1B shows a side view of the CMP machine 100. The CMP machine 100 is fed wafers to be polished. The CMP machine 100 picks up the wafers with an arm 101 and places them onto a rotating polishing pad 102. The polishing pad 102 is made of a resilient material and is textured, often with a plurality of predetermined groves 103, to aid the polishing process. The polishing pad 102 rotates on a platen 104, or turn table located beneath the polishing pad 102, at a predetermined speed. A wafer 105 is held in place on the polishing pad 102 and the arm 101 by a carrier ring 112 and a carrier film 106. The lower surface of the wafer 105 rests against the polishing pad 102. The upper surface of the wafer 105 is against the lower surface of the carrier film 106 of the arm 101. As the polishing pad 102 rotates, the arm 101 rotates the wafer 105 at a predetermined rate. The arm 101 forces the wafer 105 into the polishing pad 102 with a predetermined amount of down force. The CMP machine 100 also includes a slurry dispense arm 107, extending across the radius of the polishing pad 102. The slurry dispense arm 107 dispenses a flow of slurry onto the polishing pad 102.

The slurry is a mixture of de ionized water and polishing agents designed to aid chemically the smooth and predictable planarization of the wafer. The rotating action of both the polishing pad 102 and the wafer 105, in conjunction with the polishing action of the slurry, combine to planarize, or polish, the wafer 105 at some nominal rate. This rate is referred to as the removal rate. A constant and predictable removal rate is important to the uniformity and through-put performance of the wafer-fabrication process. The removal rate should be expedient, yet yield precisely planarized wafers, free from surface anomalies. If the removal rate is too slow, the number of planarized wafers produced in a given period of time decreases, hurting wafer through-put of the fabrication process. If the removal rate is too fast, the CMP planarization process will not be uniform across the surface of the wafers, hurting the yield of the fabrication process.

To aid in maintaining a stable removal rate, the CMP machine 100 includes a conditioner assembly 120. The conditioner assembly 120 includes a conditioner arm 108, which extends across the radius of the polishing pad 102. An end-effector 109 is connected to the conditioner arm 108. The end-effector 109 includes an abrasive conditioning disk 110 which is used to roughen the surface of the polishing pad 102. The conditioning disk 110 is rotated by the conditioner arm 108 and is translationally moved toward the center of the polishing pad and away from the center of the polishing pad 102, such that the conditioning disk 110 covers the radius of the polishing pad 102. In so doing, conditioning disk 110 covers the surface area of the polishing pad 102, as polishing pad 102 rotates. A polishing pad having a roughened surface has an increased number of very small pits and gouges in its surface from the conditioner assembly 120 and, therefore, produces a faster removal rate via increased slurry transfer to the surface of the wafer. Without conditioning, the surface of polishing pad 102 is smoothened during the polishing process and removal rate decreases dramatically. The conditioner assembly 120 re-roughens the surface of the polishing pad 102, thereby improving the transport of slurry and improving the removal rate.

As described above, the CMP process uses an abrasive slurry on a polishing pad. The polishing action of the slurry is comprised of an abrasive frictional component and a chemical component. The abrasive frictional component is due to the friction between the surface of the polishing pad, the surface of the wafer, and abrasive particles suspended in the slurry. The chemical component is due to the presence in the slurry of polishing agents which chemically interact with the material of the dielectric layer of the wafer. The chemical component of the slurry is used to soften the surface of the dielectric layer to be polished, while the frictional component removes material from the surface of the wafer.

Referring still to FIG. 1A and FIG. 1B, the CMP processing of semiconductor wafers having a tungsten surface layer, or a thin-film surface which includes tungsten components, presents special difficulties. Tungsten CMP is a comparatively more recently developed technique. Tungsten thin-film layers have very different polishing characteristics in comparison to other materials (e.g., silicon dioxide, aluminum, etc.). As a result, tungsten CMP has very different process characteristics during CMP than the other more mature CMP processes (e.g., silicon dioxide CMP).

As described above, the polishing action of the slurry and polishing pad 102 and the polishing motion of arm 101 determines the removal rate and the removal rate uniformity, and, thus, the effectiveness of the CMP process. Process engineers have discovered that in order to obtain sufficiently high and sufficiently stable removal rates for tungsten CMP using conventional CMP machines (e.g., CMP machine 100), a large number of tungsten wafers need to be processed on a respective CMP machine in order to "break-in" the machine's polishing pad (e.g., polishing pad 102). Each of these wafers typically will show different removal rates as they are processed.

For example, in the case of tungsten CMP processing on CMP machine 100, the first of a batch of wafers show very low removal rates. The later processed wafers show much higher removal rates. Each successive wafer processed shows an incrementally higher removal rate. For a typical process, a large number of wafers will need to be processed in order for the removal rate of the tungsten layer of the wafers to increase sufficiently, and perhaps more importantly, nominally to stabilize at a specified level. While the removal rate of CMP machine 100 is unstable (e.g., greatly increasing with each successive wafer) CMP machine 100 is unsuitable for device fabrication processing. Any fabricated device processed by CMP machine 100 and polishing pad 102 would have unpredictable planarity and film thickness, and hence would be non-functional or unreliable.

Consequently, in order adequately to break-in polishing pad 102, a large number of "test wafers" are processed in CMP machine 100. Each of the test wafers have a tungsten surface layer deposited such that it is similar to the tungsten layer of a real wafer containing real devices, and, hence, the costs of these wafers is significant. In addition to the cost of the test wafers, there is a significant time penalty associated with breaking-in each new polishing pad. To attain a nominal removal rate (e.g., 4000 to 5000 Angstroms per minute) 20 to 50 test wafers must be processed, where each wafer consumes a valuable amount of processing time. In addition, the processing of test wafers subtracts from the useful life of the polishing pad 102 since it only has a finite number of polishing cycles before it requires a change out. Another drawback of this conventional method of breaking in polishing pad 102 is the uncertainty associated with the number of test wafers which need to be processed in order properly to breaking a respective polishing pad.

Thus, what is required is a system which greatly reduces the number of test wafers required for properly conditioning (e.g., breaking-in) a polishing pad for a tungsten CMP process. What is required is a system which reduces the cost of properly breaking-in the polishing pad used in a tungsten CMP process. What is further required is a system which decreases the amount of process time required properly to condition a tungsten CMP polishing pad. Additionally, what is required is a system which increases the certainty of the break-in process. The present invention provides a novel solution to the above requirements.

DISCLOSURE OF THE INVENTION

The present invention provides a system which greatly reduces the number of test wafers required for properly conditioning (e.g., breaking-in) a polishing pad for a tungsten CMP process. The system of the present invention reduces the cost of properly breaking-in the polishing pad used in a tungsten CMP process. The system of the present invention decreases the amount of process time required properly to condition a tungsten CMP polishing pad. Additionally, the system of the present invention increases the certainty of the break-in process.

In one embodiment, the present invention comprises a complementary conditioning system for use in chemical mechanical polishing (CMP). The present invention functions with a CMP machine adapted for polishing a semiconductor wafer having tungsten components fabricated thereon. A polishing pad is mounted on the CMP machine. The polishing pad has a polishing surface configured for polishing the semiconductor wafer and its tungsten components. The performance of the polishing surface is characterized by a polishing efficiency. A complementary end-effector is mounted on the CMP machine. The complementary end-effector is adapted to complement the tungsten components on the semiconductor wafer chemically. The complementary end-effector is further adapted to contact the polishing surface and to improve the polishing efficiency by chemically enhancing the polishing surface, thereby obtaining a more efficient removal rate for the chemical mechanical polishing.

In this embodiment, the complementary end-effector is adapted to interchange with the conventional prior art roughening end-effector used frictionally to roughen the surface of the polishing pad. This allows the system of the present invention to retrofit pre-existing CMP machines. The complementary end-effector functions by chemically enhancing the CMP process between the semiconductor wafer and the polishing pad and slurry, through its interaction with the surface of the polishing pad. This is distinct and separate from roughening with a conventional roughening end-effector. In so doing, the system of the present invention greatly decreases the amount of process time required properly to break-in a tungsten CMP polishing pad and potentially eliminates the use of test wafers for conditioning, thereby increasing the productivity of the CMP machine.

BRIEF DESCRIPTION OF THE DRAWINGS

The present invention is illustrated by way of example, and not by way of limitation, in the figures of the accompanying drawings and in which like reference numerals refer to similar elements and in which.

Prior art

Prior art

BEST MODE FOR CARRYING OUT THE INVENTION

A method and system for a polishing pad for use in a wafer polishing machine is disclosed. In the following description, for the purposes of explanation, numerous specific details are set forth in order to provide a thorough understanding of the present invention. It will be obvious, however, to one skilled in the art that the present invention may be practiced without these specific details. In other instances, well-known structures, devices, and processes are shown in block diagram form in order to avoid unnecessarily obscuring the present invention.

Figure 1A:
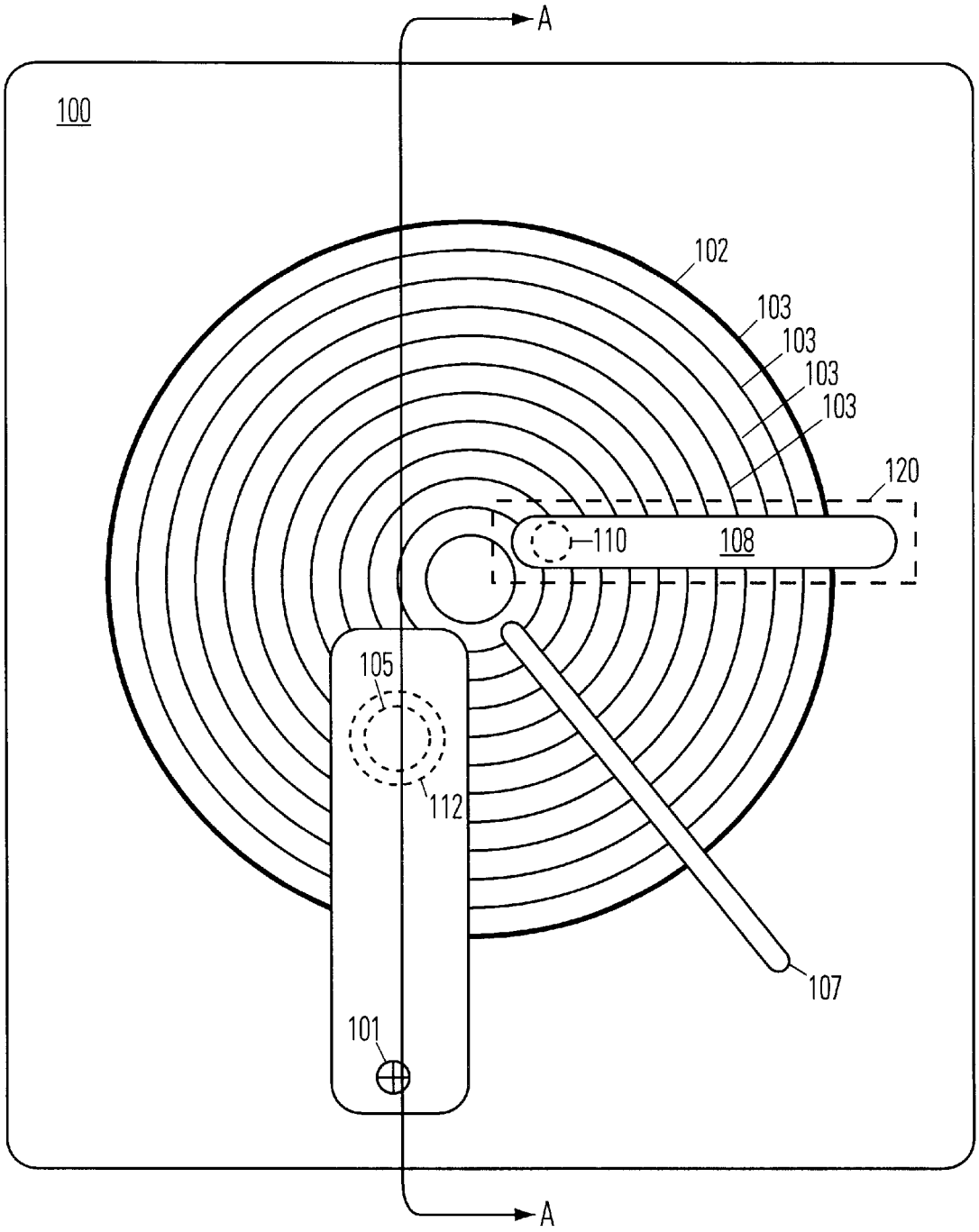
FIG. 1A (Prior Art)
FIG. 1A shows a top view of a prior art CMP machine.
Figure 1B:
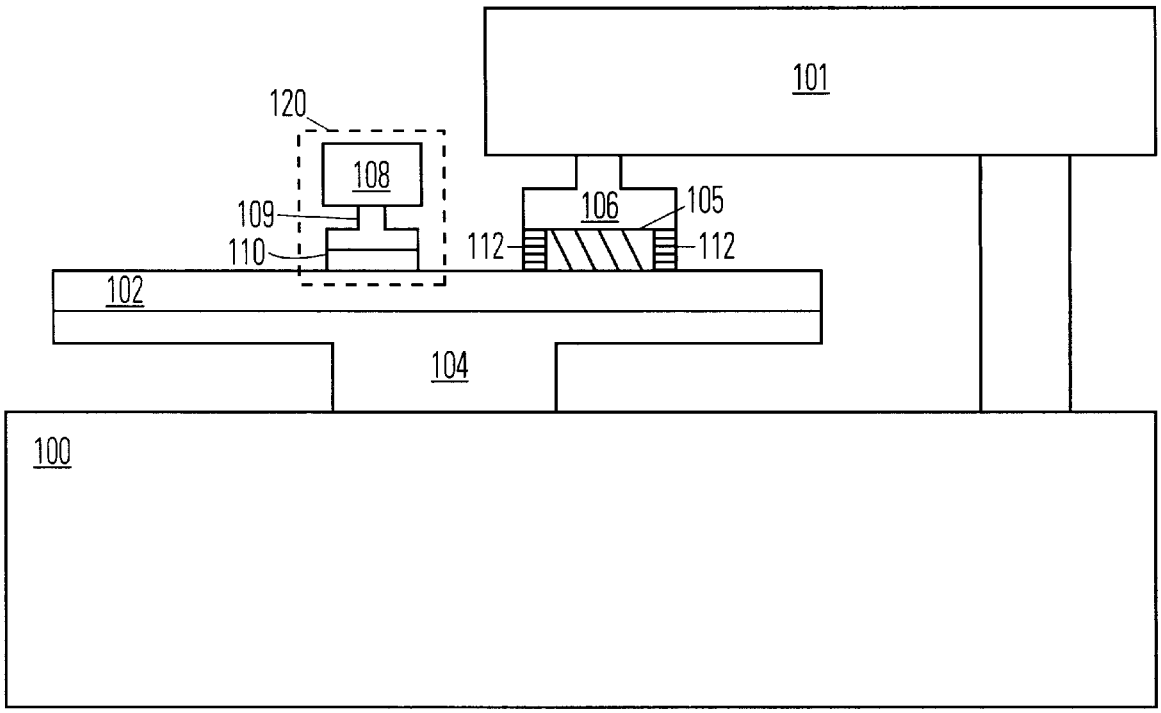
FIG. 1B (Prior Art)
FIG. 1B shows a side section view of the prior art CMP machine of FIG. 1A taken through line BB.
Figure 2A:
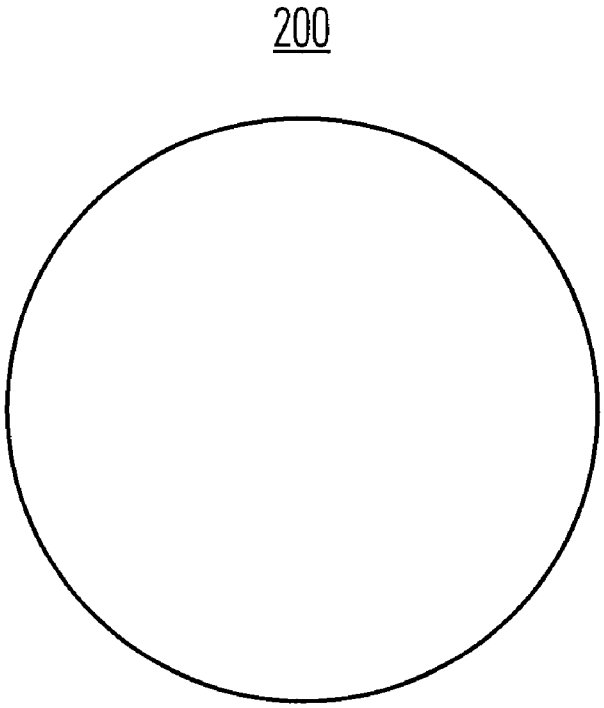
FIG. 2A shows a down view of a complementary end-effector in accordance with one embodiment of the present invention.
Figure 2B:
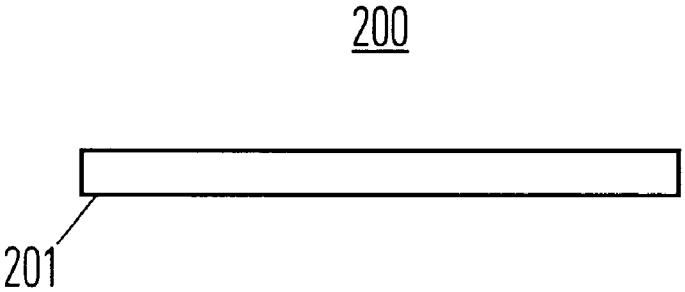
FIG. 2B shows a side section view of the complementary end-effector of FIG. 2A taken through line AA.

Referring now to FIG. 2A and FIG. 2B, a complementary end-effector 200 in accordance with one embodiment of the present invention is shown. FIG. 2A shows a down view of complementary end-effector 200. FIG. 2B shows a side view of complementary end-effector 200 and a surface 201 of complementary end-effector 200. In the present embodiment, complementary end-effector 200 is comprised of tungsten.

Complementary end-effector 200 is fabricated to complement chemically components fabricated on a surface of a semiconductor wafer. In the present embodiment, complementary end-effector 200 is used in tungsten CMP processing. For example, in a case where a semiconductor wafer having tungsten components fabricated thereon (hereinafter tungsten wafers), complementary end-effector 200 is comprised of tungsten in order to complement the CMP processing of the wafer. Complementary end-effector 200 has a surface 201 adapted to contact the polishing surface of a polishing pad of a chemical mechanical polishing machine. As a wafer is being processed in a CMP machine, commentary end-effector 200 is also processed and exposed to the same conditions as the wafer (e.g., frictional contact with the CMP machines polishing pad and slurry). The tungsten of surface 201 chemically enhances the polishing surface of the polishing pad of the CMP machine. This chemical enhancement improves the polishing efficiency of the polishing pad and CMP machine in the same manner as if a large number of "break-in wafers" had been polished.

It should be appreciated that the present invention is not limited to functioning with tungsten wafers. The complementary end-effector 200 is fabricated of the appropriate material (e.g., tungsten, gold, copper, etc.) to perform the conditioning required to obtain optimum efficiency. For example, in the case of processing a semiconductor wafer having components fabricated in gold, complementary end-effector 200 is also fabricated out of gold. In the case of processing a wafer having components fabricated in copper, complementary end-effector 200 is also fabricated out of copper. Hence the term "complementary."

Referring still to FIG. 2A and FIG. 2B, it should be further appreciated that the shape of complementary end-effector 200 is dictated by the particular requirements of the CMP machine in which the present invention functions. In the present embodiment, complementary end-effector 200 is designed to be interchangeable with a standard, prior art roughening end-effector used in a conditioner assembly. For example, where a conventional CMP machine includes a conditioner assembly for roughening its polishing pad, the prior art roughening end-effector is replaced with the complementary end-effector of the present invention, thereby retrofitting the conventional CMP machine to function in accordance with the present invention.

Alternatively, complementary end-effector 200 of the present invention can be used in conjunction with conventional prior art conditioning (e.g., roughening). In such an embodiment, a separate commentary conditioning assembly would be mounted on the CMP machine to enhance chemically the CMP machine's polishing pad in addition to the conventional prior art conditioning (e.g., roughening) of the polishing pad. In such an embodiment, the form of the complementary end-effector of the present invention would not be limited by the requirement of having mechanically to match the conditioner assembly physical interface (e.g., be interchangeable with the prior art roughening end-effector). Accordingly, the configuration (e.g., size, shape, thickness, etc.) of the complementary end-effector of the present invention would be limited only by the particular requirements of the CMP machine.

Figure 3A:
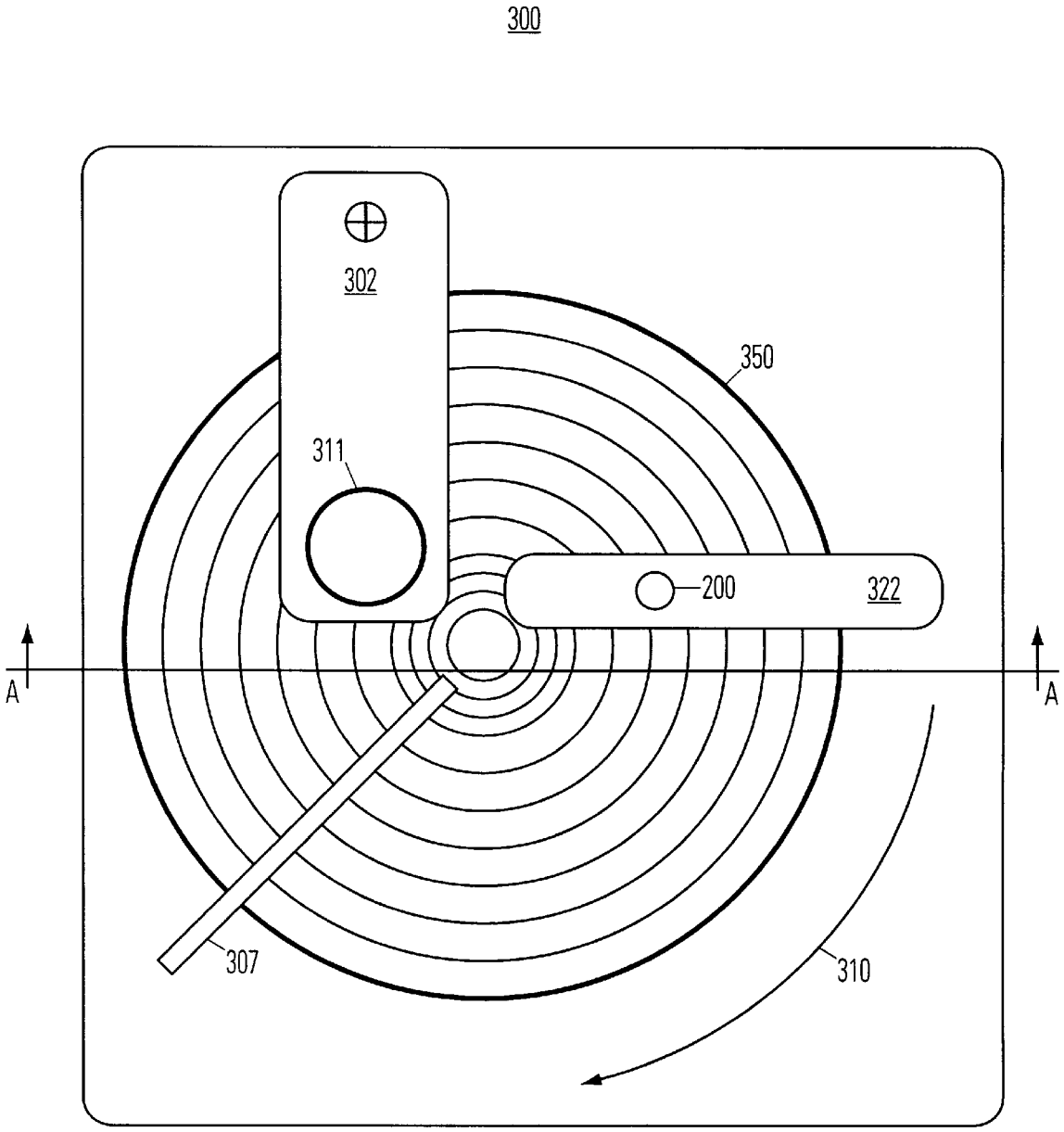
FIG. 3A shows a top view of a CMP machine including the complementary end-effector of the present invention.
Figure 3B:
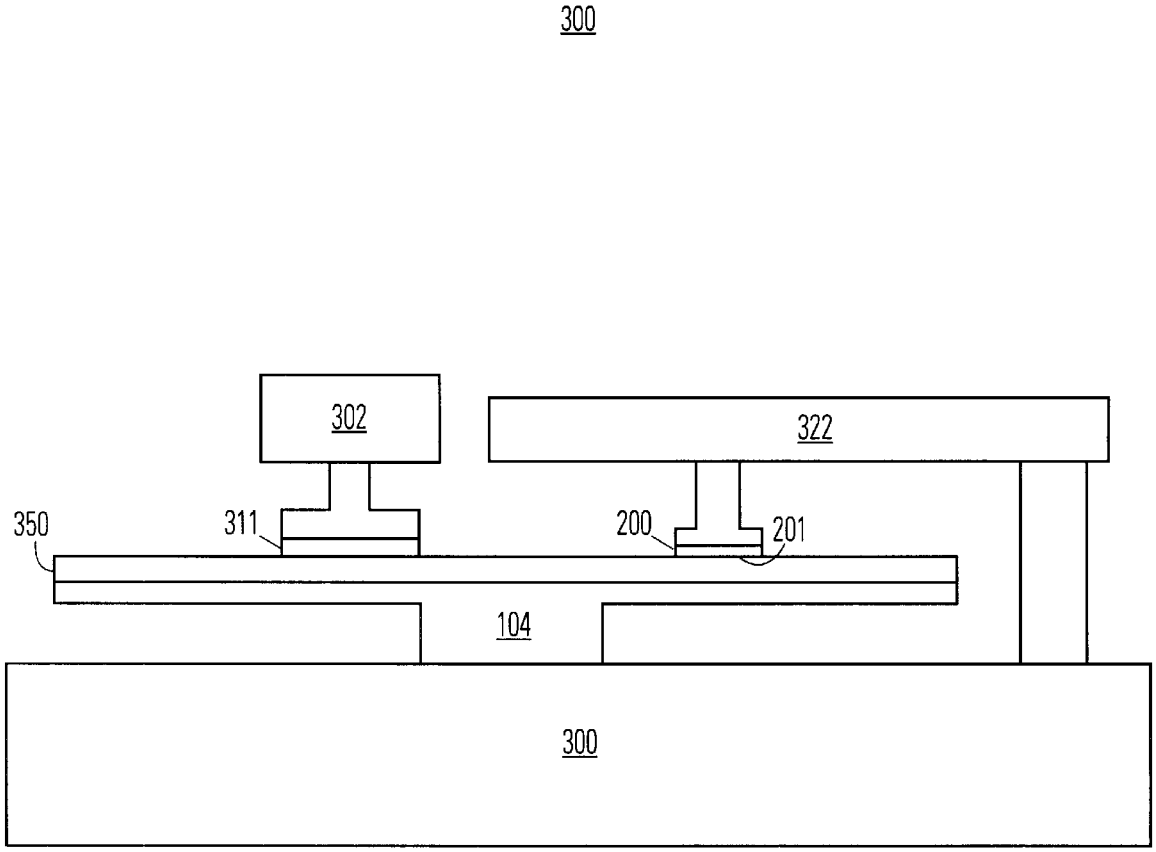
FIG. 3B shows a side section view of the CMP machine and complementary end-effector of FIG. 3A.

Referring now to FIG. 3A and FIG. 3B, a top view of a CMP machine 300 using the complementary end-effector 200 in accordance with one embodiment of the present invention and a side section view of CMP machine 300 taken through line AA are shown. CMP machine 300 picks up wafers with an arm 302 and places them onto the rotating polishing pad 350. The polishing pad 350 rotates on a platen 104, located beneath polishing pad 350, at a predetermined speed. The arm 302 forces a tungsten wafer 311 into the polishing pad 350 with a predetermined amount of downward force. The lower surface of tungsten wafer 311 rests against polishing pad 350. The upper surface of tungsten wafer 311 is against the wafer carrier of arm 302. As described above, tungsten wafer 311 has tungsten components fabricated on its surface. As polishing pad 350 rotates (as shown by arrow 310) arm 302 rotates tungsten wafer 311 at a predetermined rate. While rotating the tungsten wafer 311, arm 302 moves tungsten wafer 311 toward and away from the center of polishing pad 350. The CMP machine 300 also includes a slurry dispense arm 307 extending across the radius of polishing pad 350. The slurry dispense arm 307 dispenses a flow of slurry onto polishing pad 350.

The slurry is a mixture of de-ionized water and polishing agents designed to aid chemically and mechanically the smooth and predictable planarization of the wafer. The rotating action of both polishing pad 350 and tungsten wafer 311, in conjunction with the polishing action of the slurry, combine to planarize, or polish, tungsten wafer 311 at some nominal rate. This rate is referred to as the removal rate. A constant and predictable removal rate is important to the uniformity and throughput performance of the wafer-fabrication process. The removal rate should be expedient, yet yield precisely planarized wafers, free from surface anomalies. If the removal rate is too slow, the number of planarized wafers produced in a given period of time decreases, hurting wafer through-put of the fabrication process. If the removal rate is too fast, the CMP planarization process will not be uniform across the surface of the wafers, hurting the yield of the fabrication process.

The complementary conditioning of the present invention makes the CMP planarization process much more efficient, in that the removal rate is sufficiently high and sufficiently stable throughout the process cycle (e.g. throughout a batch of wafers being processed, from those early in the batch to those later in the batch). As described above, the present invention chemically enhances the CMP process of CMP machine 300 in the same manner as if a very large number of break-in wafers were processed.

In the present embodiment, CMP machine 300 uses complementary end-effector 200 in place of its conventional roughening end-effector. As described above, complementary end-effector 200 is adapted to replace the conventional roughening end-effector, thereby retrofitting CMP machine 300 to function in accordance with the present invention. Hence, conditioner assembly 322 performs the complementary conditioning of the present invention. Complementary end-effector 200 is rotated by conditioner assembly 322 and is translationally moved back and fourth across the radius of polishing pad 350. Surface 201 of complementary end-effector 200 frictionally contacts the surface of polishing pad 350 as complementary end-effector 200 is moved by conditioner assembly 322. Instead of roughening, as is the case with a conventional prior art roughening end-effector, complementary end-effector 200 chemically enhances the CMP performance of polishing pad 350 through its complementary conditioning action. The tungsten of surface 201 of complementary end-effector 200 enhances the removal rate of polishing pad 350 and the slurry. This enhancement is due, in part, to the interaction of the tungsten of surface 201 with the chemical component of the slurry and the mechanical friction of the polished pad.

When CMP machine 300 is used with an acid slurry, the surface of tungsten wafer 311 is oxidized by the chemical component of the slurry followed by mechanical abrasion of that oxide by the friction with the polishing pad 350. Depending upon the oxide and abrasive contained in the slurry, the passivation/abrasion process is altered by the presence of tungsten in an adhesion layer on the surface of pad 350. The action of complementary end-effector 200 of the present invention has a beneficial effect on this passivation/abrasion process. In the same manner that processing a large number of break-in wafers alters the passivation/abrasion process to effect an increase in removal rate, CMP in accordance with the present invention (e.g., using complementary end-effector 200) alters the interaction of the chemical and abrasive components of the slurry, in conjunction with friction from polishing pad 350, to effect at least the same increase in removal rate.

Figure 4:
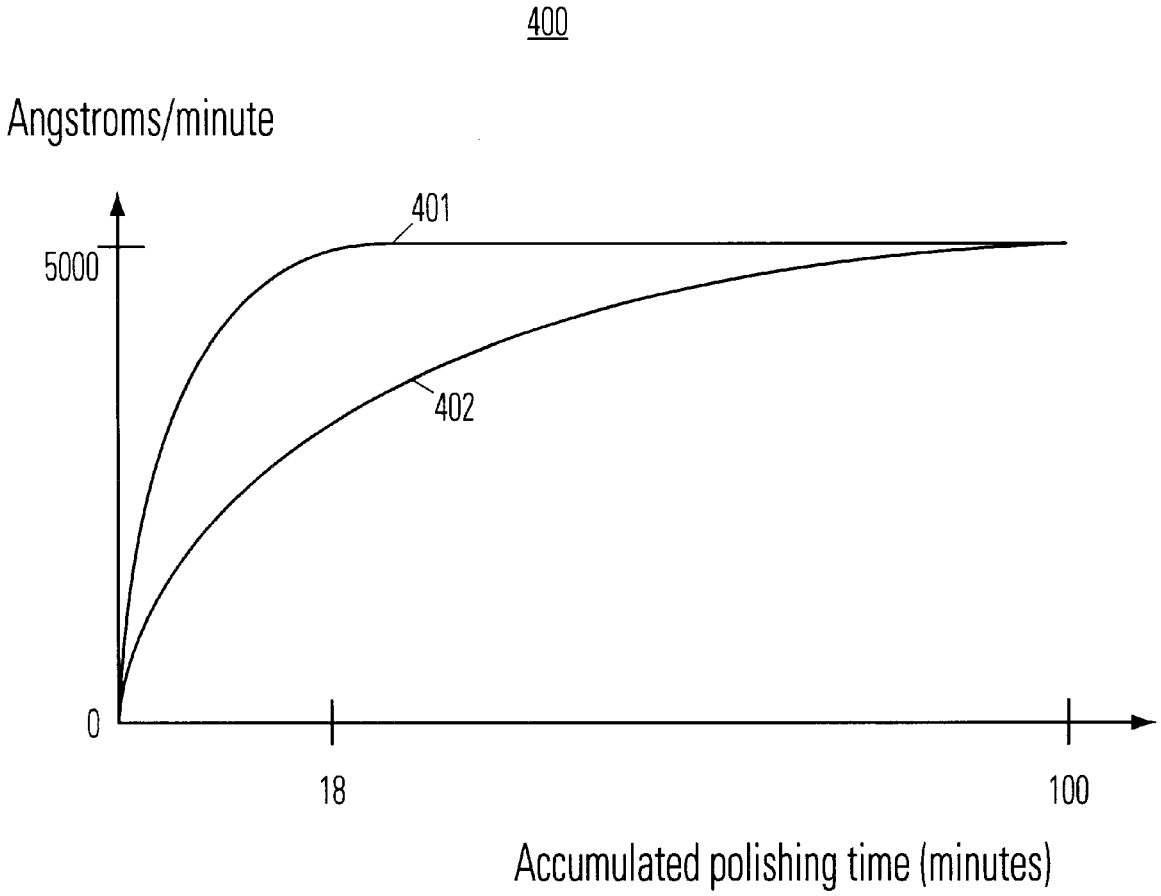
FIG. 4 shows a graph of the removal rate of a CMP process in accordance with one embodiment of the present invention versus the removal rate of a prior art CMP process.

Referring now to FIG. 4, a graph showing the removal rate of a CMP machine (e.g. CMP machine 300) in accordance with the present invention is shown. The vertical axis of graph 400 shows the removal rate (in Angstroms per minute) for a tungsten wafer (e.g., tungsten wafer 311) undergoing CMP. The horizontal axis of graph 400 shows accumulated polishing time for the tungsten wafer (in minutes). Line 401 shows the removal rate of CMP in accordance with the present invention. Line 402 shows removal rate of CMP in accordance with the prior art (e.g., without the complementary conditioning of complementary end-effector 200).

As shown by graph 400, CMP in accordance with the present invention (e.g. line 401) yields an optimal removal rate much quicker than CMP in accordance with the prior art (e.g. line 402). CMP in accordance with present invention yielded an optimal removal rate of 5000 angstroms per minute after about the first 18 minutes of accumulated polishing time. In contrast, CMP in accordance with the prior art (e.g., line 402) did not reach the optimal removal rate of 5000 angstroms per minute until after approximately 100 minutes of accumulated polishing time. Hence, to achieve a nominal removal rate of 5000 angstroms per minute with a CMP machine in accordance with the prior art, a large number of break-in wafers need to be processed.

Figure 5:
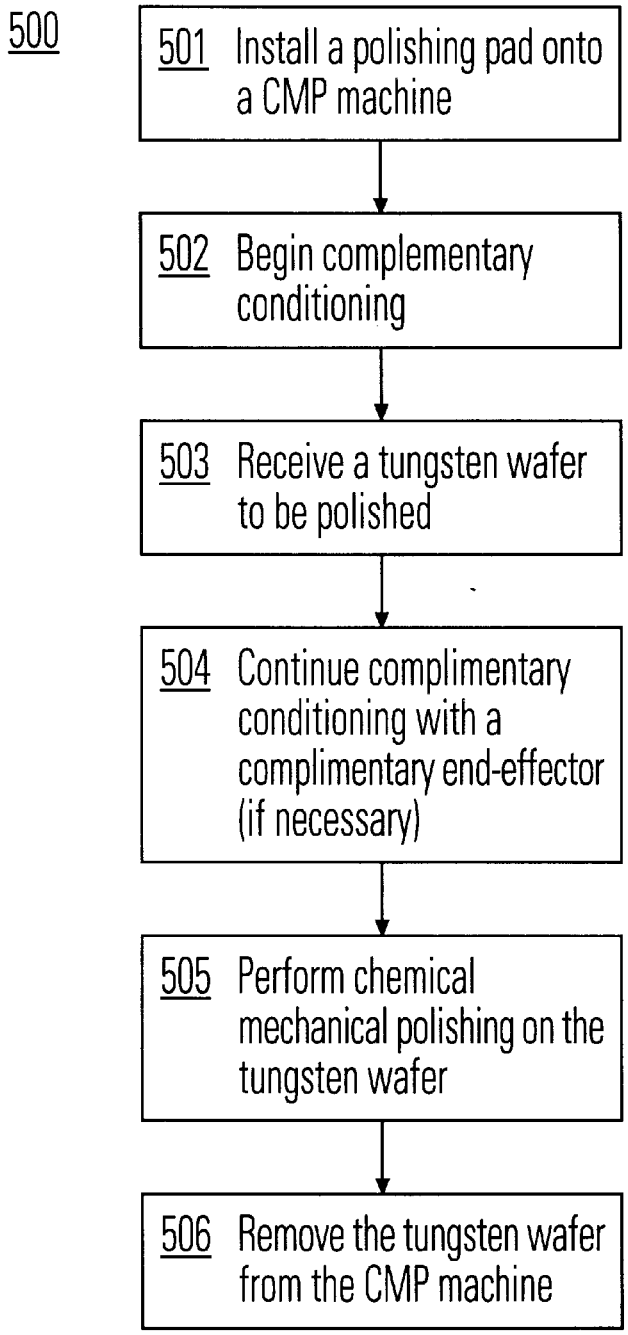
FIG. 5 shows a flow chart of the steps of a CMP process in accordance with one embodiment of the present invention.

With reference now to FIG. 5, a flowchart of the steps of a process 500 in accordance with one embodiment of the present invention is shown. Process 500 shows the steps of an operating process of a CMP machine in accordance with one embodiment of the present invention.

In step 501, a polishing pad (e.g., polishing pad 350) is installed in a CMP machine (e.g., CMP machine 300). The CMP machine is equipped with a complementary end-effector (e.g., complementary end-effector 200) in accordance with one embodiment of the present invention.

In step 502, the polishing pad is conditioned using the complementary end-effector of the present invention. As described above, this chemically enhances the polishing surface of the polishing pad.

In step 503, a CMP machine (e.g., CMP machine 300) equipped with a complementary end-effector 200 in accordance with the present invention receives a tungsten wafer (e.g., tungsten wafer 311) to be polished. The CMP machine polishes wafers as part of an overall wafer-fabrication process. Each tungsten wafer received for polishing includes a plurality of tungsten integrated circuit components fabricated on the wafer surface and is being polished to aid the photolithography process.

In step 504, the CMP machine continues complementary conditioning in accordance with the present invention, as required. As described above, a slurry is dispensed onto the polishing pad of the CMP machine. The surface of the plate of the present invention is placed into contact with the surface of polishing pad and is frictionally moved along the surface by the conditioner assembly. In so doing, the polishing efficiency of the CMP process (e.g., as measured by the removal rate) is increased. Tungsten from the plate of the present invention enhances the removal rate of the polishing pad and slurry.

In step 505, the tungsten wafer 311 is placed onto the surface of polishing pad 350 and is polished by the CMP machine. As described above, the removal rate is sufficiently high and sufficiently stable such that the tungsten wafer is planarized to a specified uniformity. Processing proceeds in a fast and efficient manner. As described above, since the removal rate is sufficiently high, wafers can be processed quickly. Since the removal rate is stable, wafers are planarized within specification, thus increasing device yields.

In step 506, the tungsten wafer 311 is removed from the surface of polishing ad. Having been planarized in the CMP processing of the present invention, the wafer is now ready for further fabrication processing (e.g., photolithography, deposition, or the like).

Thus, the present invention provides a system which greatly reduces the number of test wafers required for properly conditioning (e.g., breaking-in) a polishing pad for a tungsten CMP process. The system of the present invention reduces the cost of properly breaking the polishing pad used in a tungsten CMP process. The system of the present invention decreases the amount of process time required to properly condition a CMP polishing pad for use in a tungsten polishing process. Additionally, the present invention increases the certainty of the break-in process.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, thereby enabling others skilled in the art best to utilize the invention and various embodiments with various modifications as are suited to the particular use contemplated. It is intended that the scope of the invention be defined by the claims appended hereto and their equivalents.

What is claimed is:

1. A complementary conditioning system for use in chemical mechanical polishing (CMP), comprising:

a CMP machine adapted for polishing a semiconductor wafer, said semiconductor wafer having tungsten components fabricated thereon;

a polishing pad mounted on said CMP machine, said polishing pad having a polishing surface configured for polishing said semiconductor wafer, said polishing surface characterized by a polishing efficiency;

a complementary end-effector mounted on said CMP machine, said complementary end-effector adapted to contact said polishing surface and improve said polishing efficiency by chemically enhancing said polishing surface, wherein tungsten from a surface of said complementary end-effector chemically enhances said polishing surface.

2. The system of claim 1, wherein tungsten from a surface of said complementary end-effector chemically enhances said polishing efficiency using a slurry dispensed onto said polishing surface, said slurry used in conjunction with said polishing surface for polishing said semiconductor wafer.

3. The system of claim 1, wherein said complementary end-effector is adapted to function with a conditioner assembly of said CMP machine.

4. The system of claim 3, wherein said complementary end-effector is adapted to interchange with a roughening end-effector used by said conditioner assembly.

5. The system of claim 3, wherein said complementary end-effector is frictionally moved across said polishing surface by said conditioner assembly to effect said enhancing.

6. A complementary conditioning system for use in chemical mechanical polishing (CMP), comprising:

a CMP machine adapted for polishing a semiconductor wafer, said semiconductor wafer having components fabricated thereon;

a polishing pad mounted on said CMP machine, said polishing pad having a polishing surface configured for polishing said semiconductor wafer, said polishing surface characterized by a polishing efficiency; and a complementary end-effector mounted on said CMP machine, said complementary end-effector having an effector surface complementary with respect to said components, said effector surface adapted to contact said polishing surface and improve said polishing efficiency by chemically enhancing said polishing surface with respect to said components, wherein said effector surface is tungsten and said components of said wafer include tungsten components.

7. The system of claim 6, wherein material from said effector chemically enhances said polishing surface.

8. The system of claim 6, wherein material from said effector chemically enhances said polishing efficiency using a slurry dispensed onto said polishing surface, said slurry used in conjunction with said polishing surface for polishing said semiconductor wafer.

9. The system of claim 6, wherein said complementary end-effector is adapted to function with a conditioner assembly of said CMP machine.

10. The system of claim 9, wherein said complementary end-effector is adapted to interchange with a roughening end-effector used by said conditioner assembly.

11. The system of claim 9, wherein said complementary end-effector is frictionally moved across said polishing surface by said conditioner assembly to effect said enhancing.

12. In a chemical mechanical polishing (CMP) machine for planarizing semiconductor wafers in a semiconductor device fabrication process, a method for complementary conditioning of a CMP process, the method comprising the steps of:

a) dispensing a slurry onto a polishing surface of a polishing pad of said CMP machine;

b) chemically enhancing said polishing surface of said polishing pad by using a complementary end-effector;

c) placing a semiconductor wafer having a plurality of components fabricated thereon onto said polishing surface;

d) polishing said wafer using said polishing surface and said slurry;

e) removing said wafer from said polishing surface, wherein said end-effector includes a tungsten surface and wherein said plurality of components includes tungsten components.

13. The method of claim 12 wherein said complementary end-effector is mounted on said CMP machine, said complementary end-effector having an effector surface complementary with respect to said components.

14. The method of claim 12 wherein said end-effector chemically enhances said polishing surface with respect to said components by frictionally contact said polishing surface and said slurry.

15. The system of claim 12 further including the step of frictionally moving said complementary end-effector across said polishing surface by using a conditioner assembly mounted on said CMP machine.

* * * * *